US006503442B1

(12) United States Patent
Fukubayashi

(10) Patent No.: US 6,503,442 B1
(45) Date of Patent: Jan. 7, 2003

(54) METAL-ZIRCONIA COMPOSITE COATING WITH RESISTANCE TO MOLTEN METALS AND HIGH TEMPERATURE CORROSIVE GASES

(75) Inventor: Harold Haruhisa Fukubayashi, Indianapolis, IN (US)

(73) Assignee: Praxair S.T. Technology, Inc., North Haven, CT (US)

( * ) Notice: Subject to any disclaimer, the term of this patent is extended or adjusted under 35 U.S.C. 154(b) by 16 days.

(21) Appl. No.: 09/810,451

(22) Filed: Mar. 19, 2001

(51) Int. Cl.[7] ..... C21B 7/16
(52) U.S. Cl. ..... 266/270; 266/280
(58) Field of Search ..... 266/265, 268, 266/270, 280, 222

(56) References Cited

U.S. PATENT DOCUMENTS 2,714,563 A 8/1955 Poorman et al. ..... 117/105
3,977,660 A 8/1976 Nakahira ..... 266/265
4,189,130 A 2/1980 Watanabe et al. ..... 266/270
4,898,368 A 2/1990 Schaffer et al. ..... 266/222
4,902,539 A 2/1990 Jackson ..... 427/423

*Primary Examiner*—Scott Kastler
(74) *Attorney, Agent, or Firm*—Blake T. Biederman

(57) ABSTRACT

The coated device contains a coating for use with corrosive environments at high temperatures. The device has a bond coat consisting essentially of, by weight percent, 0 to 5 carbon, 20 to 40 chromium, 0 to 5 nickel, 0 to 5 iron, 2 to 25 total molybdenum plus tungsten, 0 to 3 silicon 0 to 3 boron and balance cobalt and essential impurities to provide sulfidation resistance at high temperatures. A zirconia-base ceramic coating covers the bond coat for heat resistance. Optionally, a boride or carbide coating covers the zirconia for additional resistance to erosion.

16 Claims, No Drawings

METAL-ZIRCONIA COMPOSITE COATING WITH RESISTANCE TO MOLTEN METALS AND HIGH TEMPERATURE CORROSIVE GASES

TECHNICAL FIELD

This invention relates to coatings for high temperature-corrosive applications. In particular, it relates to coatings useful for extending the service life under severe conditions, such as those associated with metallurgical vessels' lances, nozzles and tuyeres.

BACKGROUND OF THE INVENTION

Tuyeres, often mounted on a bustle pipe inject air, oxygen and fuel into blast furnaces and smelters, such as Pierce-Smith converters. Similar to tuyeres, gas injection nozzles inject oxygen and fuel into electric arc furnaces' bath of molten steel. In addition, lance nozzles inject oxygen and fuel into basic oxygen furnaces used to manufacture steel. These lances, nozzles and tuyeres are usually water-cooled and made of high conductivity copper or copper-base alloys that have minimal resistance to molten slag or metal attack. In addition to these, metallurgical vessels' lances and nozzles typically experience both hot particle erosion and molten slag or metal attack.

An additional problem is the presence of corrosive gases. These corrosive gases include acids and non-acidic reactive metal vapors. The corrosive gases, such as chlorine and sulfur dioxide often originate from fuels or the oxidation of metal sulfides in the feed stock or melt. Similar to acidic gases, reactive vapors such as, cadmium, lead, zinc, etc. typically originate from their inclusion in scrap steel feed to blast and electric arc furnaces. These gases aggressively attack metal injection devices. For example, sulfur dioxide readily reacts with copper and forms sulfides such as, copper sulfide (CuS).

Nakahira, in U.S. Pat. No. 3,977,660, discloses a blast furnace tuyere coating. This coating consists of a cermet deposited on either a nickel-base or cobalt-base self-fluxing alloy and an alumina or zironia ceramic layer covering the cermet. The major disadvantage of this coating is that the self-fluxing powder requires a two-step process to obtain an adequate bond to the tuyere. The process first spray coats the self-fluxing powder to the tuyere. Then it heats the powder (and tuyere) to bond the self-fluxing alloy to the tuyere. This heating process often imparts significant distortion upon the tuyere.

Watanbe et al., in U.S. Pat. No. 4,189,130, disclose a three-layer coated copper tuyere for blast furnaces. This coating contains a metal bond layer, a cermet layer containing ceramic in a metal matrix and a ceramic top coat. As far as known, this coating did not receive widespread commercial application due to spalling of the multi-layer coating.

Yet another problem with coated tuyeres and nozzle tips is cracking after a period of service under extreme cyclic heating and cooling. This cracking can propagate toward the inner wall, causing eventual water leakage.

Schaffer et al., in U.S. Pat. No. 4,898,368, disclose a bi-layer coated tuyere deposited by flame spraying, plasma spraying, plasma deposition, detonation gun or hypersonic deposition. Most advantageously, this process used a non-transferred arc plasma deposition process. Unfortunately, Schaffer et al.'s design provided inadequate protection to justify its relatively high cost--ceramic coatings add significant cost to tuyeres, nozzles and lances—especially in comparison to tuyeres, nozzles and lances fabricated out of low cost copper-base alloys. The inadequate increase in tuyere life most likely originated from the coating's insufficient resistance to sulfidation.

As far as known, no commercial tuyere coatings have been adapted for production with either detonation gun or Super D-Gun™ devices. A detonation gun method and apparatus are described in U.S. Pat. No. 2,714,563 and a Super D-Gun™ method and apparatus are described in U.S. Pat. No. 4,902,539. A detonation gun substantially comprises a normally cylindrical, water-cooled barrel with an inside diameter of about 25.4 mm, about 1 to 2 m in length, fitted near one end with supply valves. The gun is supplied with a gaseous mixture of at least one oxidizing gas (e.g., oxygen) and at least one fuel gas (e.g. acetylene) as well as a powdered coating material, normally less than 100 micrometers in diameter. Nitrogen may be added to the gas mixture to reduce the temperature of the detonation. The gas mixture is ignited, usually with a spark, to produce a detonation wave. As the wave travels down the barrel, it heats the powder particles and accelerates the powder particles to a velocity greater than 750 m/s for a detonation gun and 1000 m/s for a Super D-Gun device.

SUMMARY OF THE INVENTION

The coated device contains a coating for use with corrosive environments at high temperatures. The device has a bond coat consisting essentially of, by weight percent, 0 to 5 carbon, 20 to 40 chromium, 0 to 5 nickel, 0 to 5 iron, 2 to 25 total molybdenum plus tungsten, 0 to 3 silicon 0 to 3 boron and balance cobalt and essential impurities to provide sulfidation resistance at high temperatures. A zirconia-base ceramic coating covers the bond coat for heat resistance. Optionally, a boride or carbide coating covers the zirconia for additional resistance to erosion.

The method forms a coated device first coating the device with a cobalt-base bond coat. Then a thermal spray device melts at least a zirconia-base ceramic powder's outer layer to form a partially molten zirconia powder. After melting the powder, the thermal spray device accelerates the partially molten zirconia-base ceramic powder to a velocity of a least 750 m/s to coat the bond coat with a series of interlocking zirconia-base ceramic agglomerations. The layer of zirconia-base ceramic agglomerations increases the coated device's heat resistance.

DESCRIPTION OF PREFERRED EMBODIMENT

The coating consists of a zirconia-base ceramic layer over an undercoat or bond layer of cobalt-base-sulfidation-resistant alloy. Optionally, a third layer of boride or carbide coating may be applied over the ceramic for additional erosion resistance. Advantageously, the device coated is an injection device for a metallurgical vessel such as a lance, nozzle or tuyere. This coating is useful for devices constructed of various metals such as cobalt-base alloys, copper, copper-base alloys, nickel-base alloys and stainless steels. Most advantageously, this coating is applied to copper or copper-base alloys.

The undercoat is a cobalt-base alloy resistant to sulfidation at high temperatures. The cobalt-base alloys of the invention advantageously contain, by weight percent, about 20 to 40 percent chromium—unless specifically expressed otherwise, all compositions provided in this specification are expressed in weight percent. The chromium provides oxidation resistance and some additional resistance to oxidation for the cobalt matrix.

A total addition of about 3 to 20 molybdenum and tungsten greatly enhances the alloy's sulfidation resistance. This is particularly important for protecting copper and copper-base alloy devices used in connection with molten metal. At the high temperatures generated with smelting and processing molten iron and steel, copper injection devices quickly react with sulfur dioxide to form detrimental CuS. The change in density associated with the sulfidation often causes ceramic coatings to spall off. In addition, ceramic coatings generally tend to have porosity and cracks that permeate the ceramic coating. These defects in the coating provide sites subject to severe crevice corrosion. For these reasons, it is essential that the coating contain at least 2 percent tungsten or molybdenum to increase the alloy's sulfidation resistance. Most advantageously, the alloy contains at least 3 percent tungsten.

In addition, it is important to limit iron and nickel to less than 5 percent, because each of these elements reduces sulfidation resistance. Maintaining these elements at levels as low as commercially practical improves the sulfidation resistance of the alloy.

Optionally, the alloy contains up to 5 percent carbon to strengthen the alloy. Carbon levels above five percent tend to decrease the corrosion resistance of the alloy.

Optionally, the alloy may contain up to three weight percent silicon or boron to lower the melting temperature of the powder. This facilitates spraying the powder as molten or partially molten powder. This spraying of molten or partially molten powder improves the interlocking of the splats formed with the thermal spray device. Advantageously, the cobalt-base bond layer relies upon a mechanical bonds to secure it to the substrate. This avoids the distortion often associated with the use of self-fluxing alloys.

The bond layer advantageously contains about the following composition, by weight percent, expressed in Table 1.

TABLE 1

| Element | Broad | Intermediate | Narrow |
|---|---|---|---|
| Carbon | 0 to 5 | 0.1 to 4 | 0.2 to 3 |
| Chromium | 20 to 40 | 22 to 36 | 25 to 35 |
| Nickel | 0 to 5 | 0 to 4 | 0 to 3 |
| Iron | 0 to 5 | 0 to 4 | 0 to 3 |
| Molybdenum + Tungsten | 2 to 25 | 2.5 to 22 | 3 to 20 |
| Molybdenum | | 0 to 15 | 0 to 10 |
| Tungsten | | 0 to 20 | 3 to 20 |
| Silicon | 0 to 3 | 0 to 2.5 | 0 to 2 |
| Boron | 0 to 3 | 0 to 2.5 | 0 to 2 |
| Cobalt * | Balance | Balance | Balance |

* Plus incidental impurities.

Table 2 lists some specific examples of sulfur dioxide resistant cobalt-base alloys.

TABLE 2

| Alloy No. | C | Cr | Ni | Fe | Mo | Si | W | Co* |
|---|---|---|---|---|---|---|---|---|
| 1 | 2.40 | 30 | 0–3 | 0–3 | | 1 | 12 | Balance |
| 6 | 1.10 | 28 | 0–3 | 0–3 | | 1 | 4 | Balance |
| 12 | 1.40 | 29 | 0–3 | 0–3 | | 1.4 | 8 | Balance |
| 21 | 0.25 | 27 | 2.8 | 0–2 | 5.5 | | — | Balance |
| 1016 | 2.50 | 32 | 0–2.5 | 0–3 | | | 17 | Balance |

*Plus incidental impurities.

A ceramic zirconia-base layer covers the sulfidation resistant underlayer. Advantageously, the zirconia-base layer is selected from the group consisting of zirconia, partially stabilized zirconia and fully stabilized zirconia. Most advantageously, this layer is a partially stabilized zirconia, such as calcia, ceria or other rare earth oxides, magnesia and yttria-stabilized zirconia. The most preferred stabilizer is yttria. In particular, the partially stabilized zirconia $ZrO_2$-$8Y_2O_3$ provides excellent resistant to heat and slag/metal adhesion.

The zirconia-base ceramic layer advantageously has a density of at least about eighty percent to limit the corrosive effects of hot acidic gases upon the under layer. Most advantageously, this density is at least about ninety percent.

The optional top layer that covers the ceramic is a heat and hot erosion resistant carbide or boride coating. The coating material may be any heat resistant chromium boride or carbide such as, CrB, $Cr_3C_2$, $Cr_7C_3$ or $Cr_{23}C_6$. The coating may be a pure carbide/boride or in a heat resistant alloy matrix of cobalt or nickel-base superalloy.

The thickness of each layer can be varied depending on the application and service environment. Advantageously, each layer has a thickness between about 50 to 1,000 micrometers (0.002" to 0.040"). Plasma, HVOF, and detonation gun and Super D-Gun™ techniques are effective for the under coat and the optional top layer. But, since HVOF provides insufficient melting of zirconia-based powders, the zirconia-base ceramic coatings can only be applied with plasma, detonation gun, or Super D-Gun™ processes.

In addition, the first and second layers can be a continuously graded coating starting with 100 percent alloy and ending with at least 99 percent ceramic. The ideal technique for this graded coating are detonation gun or Super D-Gun™ devices.

The zirconia-base coating is preferably deposited on exposed surfaces of the injection device such as tuyeres, lances or nozzles by means of a thermal spray process using a detonation gun or a Super D-Gun™ device. The coating material particles are therefore heated to a high temperature and accelerated to a high velocity (Super D-Gun is a trademark of Praxair Surface Technologies, Inc.). Most advantageously, the particle velocity is greater than about 750 m/sec for detonation gun deposition and greater than about 1000 m/sec for Super D-Gun™ deposition. The increased particle velocity improves bonding or adherence of the coating to the injection device. Projecting a molten or semi-molten state particles against the exposed surface forms an agglomeration of thin lamellar particles. These particles are overlapping, intertwined, and densely packed. Each detonation generates a circular agglomeration or splat of particles, and the continuous coating is built-up on the exposed surface to be coated by traversing the gun relative to the exposed surface in a predetermined pattern of overlapping circular agglomerations of particles.

Although not preferred at this time, other thermal spray or related processes such as high velocity oxy-fuel, high velocity air fuel, and cold spray may be viable if they are capable of generating sufficient particle velocity and particle temperature. Furthermore, it is possible to substitute very high velocity (kinetic energy) for some particle heating (thermal energy) and still achieve the desired microstructural characteristics necessary for the coatings of the injection devices.

The total coating thickness is obtained by traversing the gun or other thermal spray device relative to the exposed surface of the coated device so that it generates a precise, predetermined pattern of overlapping agglomerations of particles. More specifically, when using a detonation gun or a Super D-Gun, each circular agglomeration of particles deposited on at least one exposed surface of the injection device forms the coating portions of less than about 25 micrometers in thickness and about 15 mm to 35 mm in diameter.

The method forms a coating on a portion or all of exposed surfaces of the lance, nozzle or tuyere. In particular, it relates to depositing a coating of predetermined thickness on the exposed surface of a tuyere or other gas injection device. Preferably, the process uses a thermal spray device to coat the entire exposed surface of the injection device.

The powder particles of coating material are advantageously projected in a molten or semi-molten form against the surface of the coated device on which they flow into thin lamellar particles and are quenched very rapidly to a solid form at relatively low temperatures to form an agglomeration with a microstructure of interlocking, tightly bonded, lamellar particles. Each detonation deposits a coating portion or agglomeration that is typically less than about 20 micrometers thick and about 25 micrometers in diameter. The total coating thickness comprises multiple layers generated by traversing the gun relative to the surface to be coated in a predetermined manner such that the total coating thickness is generated by precisely placed agglomerations of coating material in an overlapping pattern.

After each detonation, the barrel of the gun is swept clean with a pulse of nitrogen and the process repeated. The detonation process is repeated several times a second so that the overall coating process is completed in a relatively short time. Each step in the process is automated and precisely controlled.

A major advantage of most of the thermal spray processes, including detonation gun and Super D-Gun processes, is the ability to deposit coatings, even those of very high melting points, without significantly heating the substrate or the part being coated. occasionally, auxiliary cooling such a jets of air or carbon dioxide are directed on the part being coated. The part temperature can be held below 150° C. without difficulty, thus no distortion or changes in the properties of the part typically associated with high temperature processes occur.

The step of depositing the coating on the exposed surface of the device may be preceded by a preliminary step of preparing the surface by, for example, grit blasting, and may be followed by a step of finishing the coated surface.

A non-limiting embodiment of the present invention will now be described purely by way of example.

EXAMPLE

For a copper-base alloy tuyere application the following coatings and coating conditions are employed:

Alloy undercoat: Alloy 6 with a thickness of 0.002" to 0.004" (50 to 100 micrometers) of Super D-Gun™. Detonation gun and Super D-Gun™ processes produce higher bond strengths than any other thermal spray techniques. This provides a particular advantage by eliminating a requirement for fused coatings and the component distortion often produced during fusing or melting of this layer. Spraying the powder at a velocity in excess of about 750 m/s produces a mechanical bond of sufficient strength to avoid spalling of the coating during use of injection devices.

Ceramic Coating: Yttria stabilized zirconia ($ZrO_2$-$8Y_2O_3$), 0.002" to 0.006" (50 to 150 micrometers) of Super D-Gun™. The zirconia coating produced with a Super D-Gun™ device has greater erosion resistance than an equivalent coating produced with a plasma technique.

Optional Carbide Layer: Chromium carbide ($Cr_3C_2$) or 80% $Cr_3C_2$ with 20% alloy 718 (50.0–55.0 Ni+Co, 17.0 to 21.0 Cr, 4.75–5.50 Nb, 2.80–3.30 Mo, 0.65–1.15 Ti, 0.20–0.80 Al and 1.0 max. Co). Apply 0.001" to 0.004" (25 to 100 micrometers) with a Super D-Gun™ device. The optional carbide coating provides additional resistance to the detrimental attack of the reactive metal vapors.

More specifically, the surfaces of the tuyeres to be coated were first cleaned and then grit blasted. The Super D-Gun™ used was a conventional gun using oxygen, acetylene and a fraction of propylene as the fuel gas, and nitrogen as a diluent. The process parameters were chosen to accelerate the particles to a velocity higher than about 1000 m/s and to heat them to a temperature such that most, but not all of the material was molten. Cooling jets of gas were used during the coating process and the temperature of the tuyere was maintained at less than 150° C.

The Co—Cr—(Mo,W)/zironia-base ceramic coating provides the following benefits: 1) excellent protection to corrosive acids and metal vapors; 2) heat resistance; 3) protection against metal and slag build up; 4) low erosion rates when exposed to splashing metal; and 5) resistance to thermal cyclic fatigue. The coating protects copper and copper-base alloys from the most severe service conditions. Furthermore, the optional boride or carbide barrier can provide additional resistance to corrosive effects of hot gases and reactive metal vapors. In addition, using a thermal spray device to deposit molten or partially molten agglomerations of zirconia-base ceramics increases the density and bond strength of the zirconia to further improve the coating's performance. This coating is particularly useful for lances, nozzles and tuyeres that are subject to the hot gases and splashing metal.

Clearly, changes can be made to the relative fabrication methods as described herein without departing from the scope of the present invention. Although the invention has been described in detail with reference to certain preferred embodiments, those skilled in the art will recognize that there are other embodiments of the invention within the spirit and the scope of the claims.

I claim:

1. A coated device for use with corrosive environments at high temperatures, the device comprising a bond coat, the bond coat having a composition consisting essentially of, by weight percent, about 0 to 5 carbon, about 20 to 40 chromium, about 0 to 5 nickel, about 0 to 5 iron, about 2 to 25 total molybdenum plus tungsten, about 0 to 3 silicon, about 0 to 3 boron and balance cobalt and essential impurities for sulfidation resistance at high temperatures; a zirconia-base ceramic coating having an interlocking lamellar structure formed from powder particles covering the bond coat for heat resistance; and a boride or a carbide top layer covering the zirconia-base ceramic coating.

2. The coated device of claim 1 wherein the bond coat contains about 22 to 36 chromium and about 2.5 to 22 total molybdenum plus tungsten.

3. The coated device of claim 1 wherein the bond coat adheres to copper or a copper-base alloy with a mechanical bond.

4. The coated device of claim 1 the zirconia-base ceramic coating is selected from the group consisting of zirconia, partially stabilized zirconia and fully stabilized zirconia.

5. A coated device for use with corrosive environments at high temperatures, the device comprising a bond coat, the bond coat having a composition consisting essentially of, by weight percent, about 0.1 to 4 carbon, about 22 to 36 chromium, about 0 to 4 nickel, about 0 to 4 iron, about 0 to 15 molybdenum, about 0 to 20 tungsten, about 2.5 to 22 total molybdenum plus tungsten, about 0 to 2.5 silicon, about 0 to 2.5 boron and balance cobalt and essential impurities for sulfidation resistance at high temperatures; a zirconia-base ceramic coating having an interlocking lamellar structure formed from powder particles covering the bond coat for heat resistance, the zirconia-base ceramic coating being selected from the group consisting of zirconia, partially stabilized zirconia and fully stabilized zirconia; and a boride or a carbide top layer covering the zirconia-base ceramic coating.

6. The coated device of claim 5 wherein the bond coat contains about 25 to 35 chromium, about 0 to 10 molybdenum, about 3 to 20 tungsten and about 3 to 20 total molybdenum plus tungsten.

7. The coated device of claim 5 wherein the bond coat adheres to copper or a copper-base alloy with a mechanical bond.

8. The coated device of claim 5 the zirconia-base ceramic coating is a partially yttria stabilized zirconia.

9. A coated injection device for use with corrosive environments at high temperatures, the injection device comprising a bond coat, the bond coat having a composition consisting essentially of, by weight percent, about 0.2 to 3 carbon, about 25 to 35 chromium, about 0 to 3 nickel, about 0 to 3 iron, about 0 to 10 molybdenum, about 3 to 20 tungsten, about 3 to 20 total molybdenum plus tungsten, about 0 to 2 silicon, about 0 to 2 boron and balance cobalt and essential impurities for sulfidation resistance at high temperatures; a zirconia-base ceramic coating having an interlocking lamellar structure formed from powder particles covering the bond coat for heat resistance, the zirconia-base ceramic coating being selected from the group consisting of zirconia, partially stabilized zirconia and fully stabilized zirconia; and a boride or a carbide top layer covering the zirconia-base ceramic coating.

10. The coated device of claim 9 wherein the bond coat contains about 1.1 carbon, about 28 chromium, about 1 silicon and about 4 tungsten.

11. The coated device of claim 9 wherein the bond coat adheres to copper or a copper-base alloy with a mechanical bond.

12. The coated device of claim 9 the zirconia-base ceramic coating is a partially yttria stabilized zirconia.

13. A method of forming a coated device for use with corrosive environments at high temperatures comprising the steps of:

coating the device with a bond coat, the bond coat having a composition consisting essentially of, by weight percent, about 0 to 5 carbon, about 20 to 40 chromium, about 0 to 5 nickel, about 0 to 5 iron, about 2 to 25 total molybdenum plus tungsten, about 0 to 3 silicon, about 0 to 3 boron and balance cobalt and essential impurities for sulfidation resistance at high temperatures;

melting at least an outer layer of a zirconia-base ceramic powder with a thermal spray device to form a partially molten zirconia powder;

accelerating the partially molten zirconia-base ceramic powder with the thermal spray device to a velocity of a least about 750 m/s to coat the bond coat with a series of interlocking lamellar zirconia-base ceramic agglomerations to increase heat resistance of the device; and depositing a boride or carbide top layer on the zirconia-base ceramic layer.

14. The method of claim 13 including the additional step of cooling the device during the deposition of the bond coat and the zirconia-base ceramic layer.

15. The method of claim 13 wherein a detonation gun melts the zirconia-base ceramic powder and accelerates the molten partially molten zirconia-base ceramic.

16. The method of claim 13 wherein a detonation gun melts the zirconia-base ceramic powder and accelerates the molten partially molten zirconia-base ceramic to a velocity of at least about 1000 m/s.

* * * * *